United States Patent [19]

Masters

[11] Patent Number: 4,589,365

[45] Date of Patent: May 20, 1986

[54] OPEN-COCKPIT KAYAK

[76] Inventor: William E. Masters, 313 Dogwood La., Easley, S.C. 29640

[21] Appl. No.: 665,949

[22] Filed: Oct. 29, 1984

[51] Int. Cl.[4] ..... B63B 35/72

[52] U.S. Cl. ..... 114/347; 114/352; 114/363

[58] Field of Search ..... 114/347, 363, 364, 352; 297/466

[56] References Cited

U.S. PATENT DOCUMENTS

| | | | |
|---|---|---|---|
| 3,769,645 | 11/1973 | Lettman | 114/363 |
| 4,106,143 | 8/1978 | Lucas | 114/363 |
| 4,229,850 | 10/1980 | Arcouette | 114/347 |
| 4,407,216 | 10/1983 | Masters | 114/363 |

*Primary Examiner*—Sherman D. Basinger
*Assistant Examiner*—Jesûs D. Sotelo
*Attorney, Agent, or Firm*—Cort Flint

[57] ABSTRACT

An open pit kayak (10) is illustrated having an open cockpit (A) in which a boater (22) sits. The boater is effectively interbraced in the open cockpit by foot braces (38), thigh braces (68), and a rear hip brace surface (60) against which the boater braces himself during boating. The thigh brace (38) includes a pair of wing members (70) and (72) which extend over an open-cockpit deck (30) at a position above the deck so that the legs of the boater may be received in the thigh braces. The thigh braces extend from side support and thrust extension (64) and (66) of the cockpit which extend vertically on opposing sides of the cockpit. The wing members extend inwardly toward the center of the open cockpit and terminate to define a space (90) in which the boater's legs may be received for engagement underneath the thigh braces. The open cockpit includes a cockpit deck (30), a lower cockpit floor (34), and a cockpit seat (54) which is below the level of the cockpit deck (30) and includes contoured surfaces for supporting and interlocking the buttocks of a person during boating.

18 Claims, 6 Drawing Figures

Fig. 1.
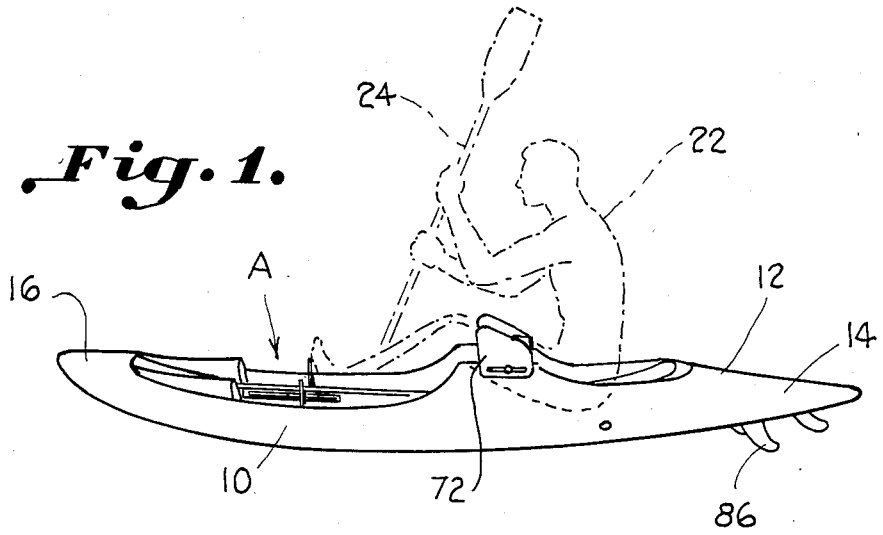
Fig. 2.
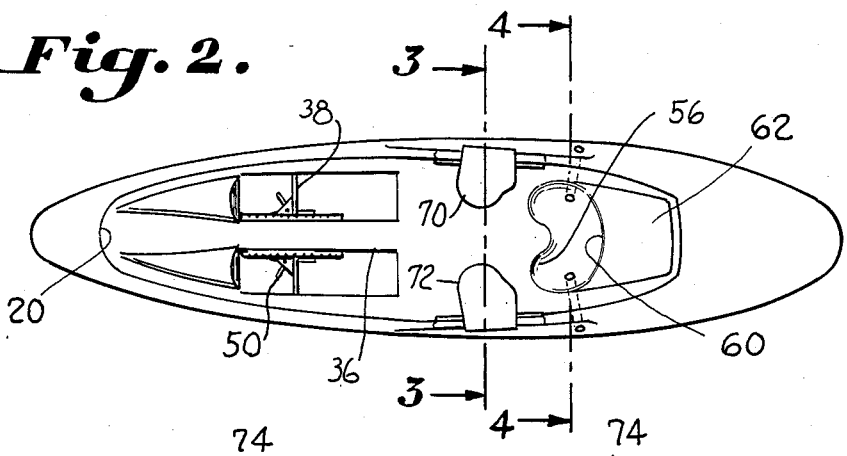
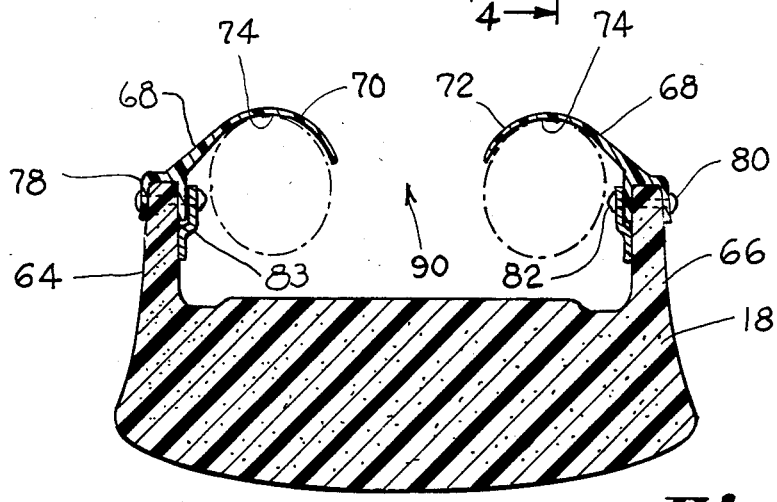
Fig. 3.

OPEN-COCKPIT KAYAK

BACKGROUND OF THE INVENTION

With the increasing popularity of boating, the kayak type boat has become increasingly popular due to its affordability and pleasure.

Typically, a kayak has included a rigid or flexible hull such as shown in U.S. Pat. Nos. 4,227,272 and 4,229,850. An inflatable kayak is shown in U.S. Pat. No. 4,031,580. The foregoing kayaks illustrated in the patents are of the conventional kayak construction wherein the boater sits in an enclosed cockpit within the hull of the kayak. Entry into the kayak is made through a small cockpit opening in the upper deck of the kayak. The boater sits in a seat generally enclosed within the hull. The cockpit opening is, typically, very small and is of sufficient size only to permit the ingress and egress of the boater. The popularity and use of this type boat for white-water boating has grown immensely over the years.

However there are many boating activities for which a kayak is highly suitable which do not require an enclosed cockpit type kayak described above. Moreover, certain persons do not enjoy the confinement of being enclosed in the small cockpit opening of a typical kayak, yet this type person does enjoy kayak boating. In kayaking, a double-bladed oar is typically utilized, and thrusts from the alternate paddling on one side of the kayak and then the other needs be transmitted through the body of the boater and the kayak for propelling and guiding the kayak. Thus, some structural connection must be made. In the typical closed-cockpit kayak, numerous engagements between the body and the kayak are made such as the knees or thighs engaging certain framework portions of the kayak.

In U.S. Pat. No. 4,106,143 a surf ski is disclosed which includes an open-cockpit area and a generally T-shaped brace is provided in the middle of the surf ski by which the boater may engage himself and transmit thrust for propelling the boat. However, this type of arrangement is not suitable for many types of boating applications for which a kayak is used such as in fairly rough water or whitewater conditions.

Accordingly, an important object of the present invention is to provide a kayak type boat having an open cockpit in which a boater may effectively secure himself.

Still another important object of the present invention is to provide a kayak having an open cockpit in which a boater may be effectively secured for retention in a seated position and for transmitting thrust for propelling the kayak.

Still another important object of the present invention is to provide an open-cockpit kayak having an open cockpit which is contoured and provided with bracing features such that a boater may brace himself in the cockpit for retention in rough water conditions and which bracing will interlock the boater within the open cockpit and effectively transmit thrust for propelling the kayak as the boater paddles the kayak.

SUMMARY OF THE INVENTION

The above objectives are accomplished according to the present invention by providing a kayak having an elongated hull with an upper deck. An open cockpit is formed in the upper deck as defined by a continuously open perimeter around the cockpit opening. A raised cockpit deck is formed in the cockpit opening and a cockpit floor is formed beneath the cockpit deck in which foot brace members are provided. A contoured seat is provided in the rear portion of the open cockpit which is below the level of the cockpit deck and includes a rear hip brace surface against which the boater is braced when seated in the cockpit with his feet braced against the foot brace members. Side support and thrust extensions extend vertically on opposing sides of the open cockpit adjacent the cockpit deck. Thigh brace members in the form of concave wings extend out laterally over the cockpit deck at a position spaced above the cockpit deck. The thighs engage the wing members and are braced there against when the boater is seated in the cockpit with his feet braced against the foot braced members and his hips braced against the hip brace surface. In this configuration the boater is interbraced in the cockpit for secure retention and for transmitting thrust effectively for propelling the kayak while the boater is paddling.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a side elevation illustrating an open-cockpit kayak constructed according to the present invention;

FIG. 2 is a top plan view of an open-cockpit kayak constructed in accordance with the present invention;

FIG. 3 is a section view taken along the line 3—3 of FIG. 2;

DESCRIPTION OF A PREFERRED EMBODIMENT

Figure 4:
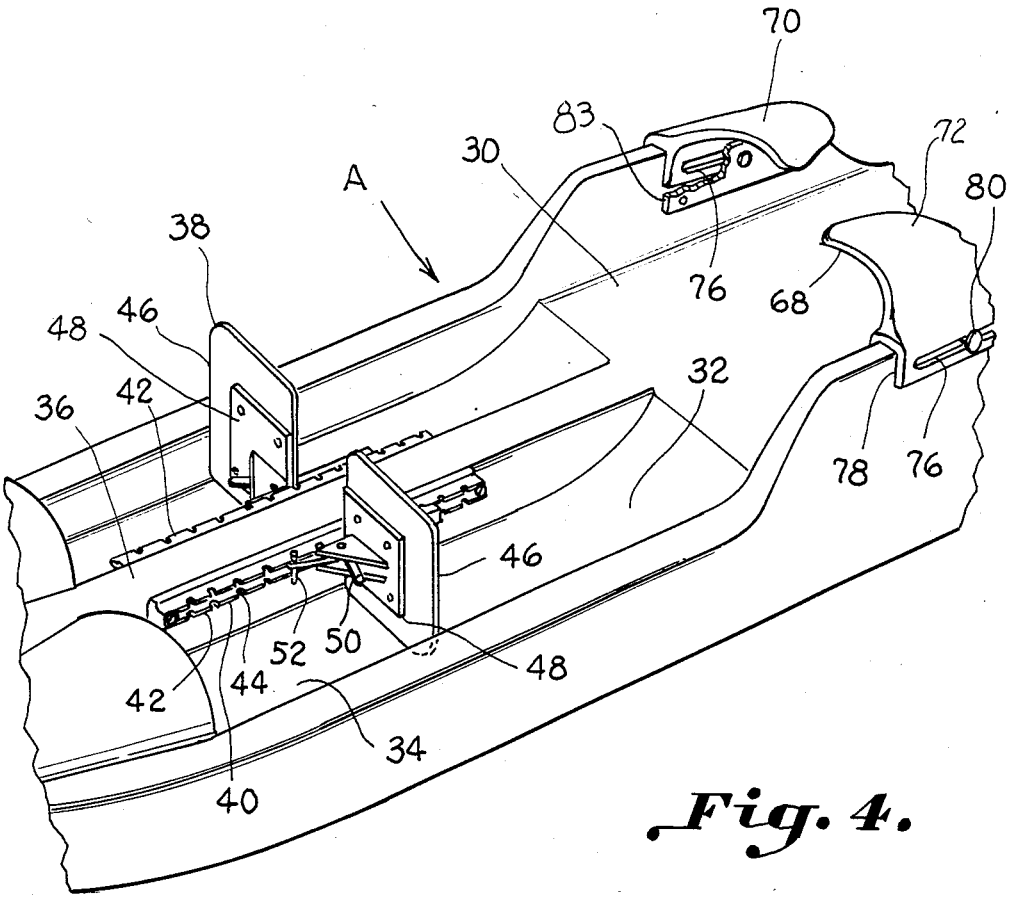
FIG. 4 is a partial perspective view illustrating foot brace members and thigh brace members for an open-cockpit kayak constructed according to the present invention.

The invention relates to a kayak type boat, and more particularly to a kayak having an open cockpit versus the closed cockpit type kayak.

Referring now in more detail to the drawings, a kayak type boat is illustrated in FIG. 1 which includes an elongated hull 10 having an upper deck 12 with an aft section 14 and a forward section 16. While the hull may be constructed in various different ways, it is preferred that the hull is molded in a rotation molding process and formed so as to have a thin skin constructed of polyethylene or other suitable plastic material. In one embodiment, the hull may be molded from a thin skinned polyethylene material having a thickness of approxmiately 1/16" and then the interior of the hull may be filled with a foam material as illustrated at 18. In another embodiment, the hull may be molded from a polyethylene material having a skin thickness of approximately 3/16" in which case it is generally not necessary to fill the interior of the hull with foam.

The upper deck of the kayak includes an open cockpit designated generally as A which is continuously open about its perimeter 20 for receiving a boater 22 in a seated position as can best be seen in FIG. 1 of the drawings. When so positioned, the boater propels the craft by means of a double-bladed oar shown at 24 which the boater pushes through the water in alternating strokes on opposite sides of the boat.

The open cockpit A includes a cockpit deck 30 having a generally horizontal surface. A cockpit floor 32 slopes downwardly from the deck 30 and includes a generally horizontal bottom floor surface 34, as can best be seen in FIG. 4. A bipartitioning runner 36 extends through the cockpit floor. Foot brace means 38 are carried adjacent a forward end of the cockpit floor against which the feet of a person sitting in the boat are braced. Foot brace adjustment means for adjusting the longitudinal position of the foot brace means 38 along the length of the floor is provided. As illustrated in FIG. 4, the adjustable foot brace means 40 includes bracket members 42 carried on opposing sides of the bipartitioning runner 36. A series of notches 44 are formed in the bracket 42. The foot brace means 38 includes a pair of foot brace plates 46, one each of which is carried on one side of the runner 36. A bracket plate 48 is affixed to the back side of each brace plate 46 and includes a runner (not shown) which slides in the bracket 42. A pivot connection is provided at 50 which includes a lock pin 52 which may be pivoted in and out of the notches 44. In this manner, each brace plate 46 may be moved in its longitudinal position along the floor and locked in place by means of the lock pin 52.

Figure 6:
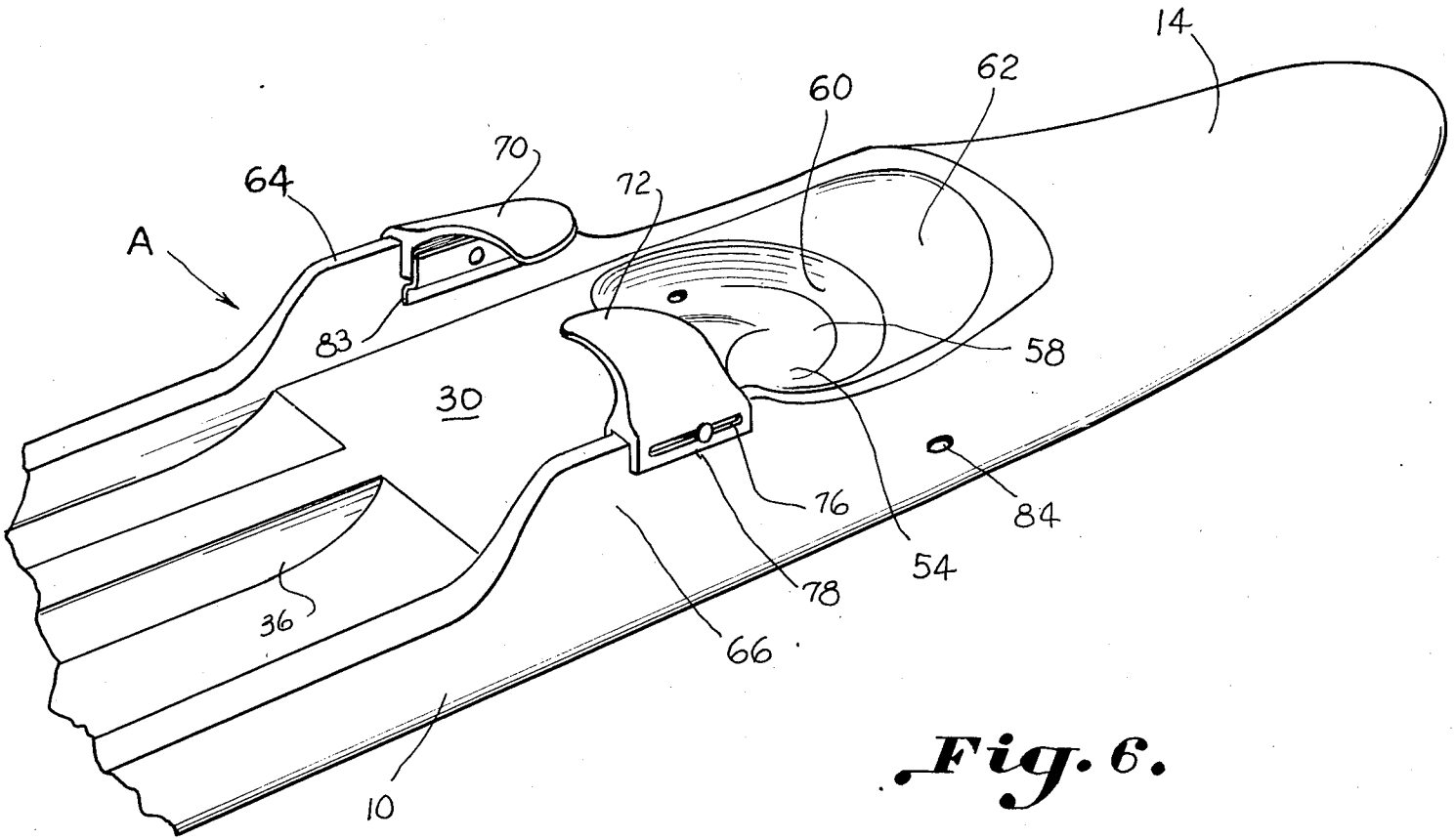
FIG. 6 is a partial perspective view illustrating thigh brace members and a contoured seat having a hip brace surface for an open-cockpit kayak constructed in accordance with the present invention.

Adjacent a rear portion of the open cockpit A is a contoured cockpit seat 54. The contoured seat portion is generally below the level of the cockpit deck 30, as can best be seen in FIG. 6. The contoured seat portion receives the buttock portion of the boater when seated in the open cockpit. The contoured seat portion 54 includes a downwardly sloping front seat surface 56 which terminates in a seat portion 58. The seat portion 58 terminates in an upwardly sloping rear hip support surface 60 which provides a means for bracing a hip portion of the seated boater while the feet of the person are braced against the foot braces means 38. The upwardly sloping hip brace surface 60 terminates generally at the level of the cockpit deck 30. Thereafter, the cockpit deck continues in an inclined surface 62 which terminates generally at the upper deck of the kayak hull.

Adjacent the cockpit deck 30 are a pair of side support and thrust extensions 64 and 66. The side extensions extend vertically on opposing sides of the cockpit A and provide for side thrust and support surfaces against which the sides of the boater's thighs and legs may be supported and thrust against during paddling.

Thigh brace means 68 extend over the cockpit deck 30 at a position above the deck so that the legs of the boater sitting in the cockpit may be received under the thigh brace means 68. As illustrated, the thigh brace means 68 includes a pair of wing members 70 and 72 which are carried by the side extensions 64 and 66 respectively. Each wing member includes a concavely curved thigh engaging surface 74 against which a thigh portion of the boater's leg engages during boating, as can best be seen in FIG. 3. The thigh braces are at such a position above the deck 30 that a person seated in seat 54 will have his thighs thrust against the brace members 70 and 72 when the foot braces 38 are properly adjusted and the feet are braced with the hips urged against hip brace surface 60. Wing members 70 and 72 terminate to define a space 90 for receiving the legs.

Means for adjustably mounting the wing members on the side extensions of the cockpit is illustrated in the form of slots 76 formed in the legs of a generally U-shaped attachment bracket 78 formed as part of each wing member. A fastening member 80 having an enlarged heat extends through the slots of the opposing legs of the brackets 78 and slideably mounts the wing members longitudinally on the side extensions. A nut member 82 may be fastened tightly so that the wing members are locked in place. A mounting flange 83 completes the assembly as can best be seen in FIGS. 3 and 4.

In a preferred form, the side extensions are formed from an extension of the hull material and the wing member 70 and 72 are formed of a more flexible material, such as a suitable plastic. Accordingly, the side extensions provide a more suitable thrust bearing surface, and the wing members, being more flexible, tend to conform to the thigh surfaces as the thighs are thrust against the thigh braces during boating.

Figure 5:
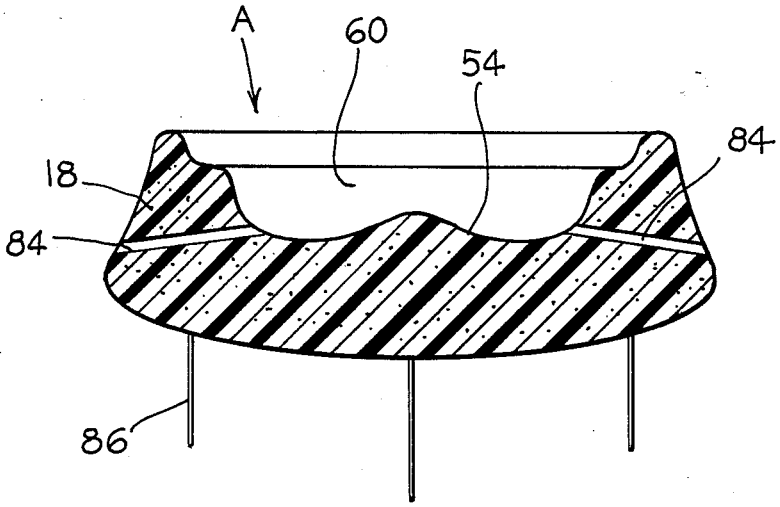
FIG. 5 is a section view taken along the line 5—5 of FIG. 2.

As can best be seen in FIG. 5, there are a pair of drain passages 84 formed in the hull 12 of the kayak which communicate with a low portion of the cockpit seat 54 and the exterior of the hull. In this manner, the water which is collected in the cockpit seat may be automatically drained from the cockpit. Stabilizing fins 86 are carried adjacent the bottom of the hull at the aft section thereof for stabilization.

The thigh braces 70 and 72 have a surface 74 not only which is concave, but which diverges. In this manner, a person seated in a normal sitting position is allowed a normal divergence of his legs prior to the lower leg portions coming back in for bracing against the foot braces. This can best be seen in FIGS. 2, 4 and 6. The concave surface is much wider at the front of the leg braces than at the rear.

Thus, it can be seen that a highly advantageous construction can be had for an open-cockpit kayak in which brace and support means are provided for effectively interbracing and retaining the boater in the open cockpit of the kayak. The boater is effectively braced in the open cockpit by the rear hip support 60, the thigh brace surfaces 74 when the feet of the boater are braced against the foot braces 38 as adjusted to the proper position. In this manner, the force against the foot braces causes the rear of the hip to push against the hip support surface and the upper portion of the thighs to brace against the thigh brace surfaces so that the boater is effectively interlocked in the open cockpit for his retention and for imparting thrust for propelling the kayak in the water.

While a preferred embodiment of the invention has been described using specific terms, such description is for illustrative purposes only, and it is to be understood that changes and variations may be made without departing from the spirit or scope of the following claims.

What is claimed is:

1. An open-cockpit kayak comprising:

an elongated buoyant hull having an upper deck, an elongated open cockpit formed in said upper deck continuously open about a cockpit perimeter for receiving a person in an open sitting position;

a cockpit deck included in said open cockpit having a generally horizontal surface;

a cockpit floor lying below said cockpit deck;

a contoured cockpit seat having a first contoured surface sloping generally downwards from said cockpit deck terminating in a contoured seat portion below the level of said cockpit deck and a second contoured surface sloping upwardly and rearwardly from said contoured seat portion providing a rear hip brace surface for bracing a hip portion of a person seated in said cockpit seat;

a pair of opposed side thrust and support extensions extending longitudinally along a length of said cockpit on opposing sides thereof and upwardly above the level of said cockpit deck;

thigh brace means carried by said side extension projecting inwardly of said opposing sides, said brace means including concavely contoured thigh engaging surfaces projecting over said cockpit deck at a position spaced above the level of said cockpit deck so that brace means may be engaged by an upper outside portion of the thighs of a person seated in said cockpit seat;

foot brace means carried adjacent ends of said cockpit floor at a position below the level of said cockpit deck for engaging the feet of said person seated in said cockpit seat; and said contoured hip brace surface, said thigh engaging brace means, and said foot brace means cooperating with one another to interbrace said person seated in said cockpit seat in such a manner that said person is effectively secured within said open cockpit for retention and transmitting thrusts effectively from manual paddle strokes to propel and guide said kayak.

2. The kayak of claim 1 comprising foot brace adjustment means for adjusting the position of said foot brace means.

3. The kayak of claim 2 wherein said cockpit includes a bipartitioning runner extending longitudinally along said cockpit floor projecting above said floor, said foot brace means extending laterally on opposing sides of said runner and carried thereon by said foot brace adjustment means.

4. The kayak of claim 1 including adjustment means carried by said cockpit side thrust and support extension for adjusting the forward and aft position of said thigh brace means.

5. The kayak of claim 1 or 4 wherein said side extensions are generally rigid so that thrusts from the body of a person sitting in the cockpit resulting from manual paddle strokes are effectively transmitted for propelling said kayak.

6. The kayak of claim 5 wherein said thigh brace means include a pair of curved wing members with one each projecting inwardly of said open cockpit above said cockpit deck, said wing members being less rigid than said side projections so that said wing members tend to conform to the shape of said thighs of said person when engaged within said concavely curved portions of said wing members whereby said thigh portion is firmly gripped.

7. The kayak of claim 1 including at least one drain passage within said hull communicating with a lower level of said contoured seat and the exterior of said hull for removing water in said cockpit seat.

8. The kayak of claim 1 wherein said second contoured sloping surface of said contoured cockpit seat terminates generally at the level of said cockpit deck and thereafter continues in an inclined cockpit surface which slopes upwardly and terminates at said upper deck of said kayak hull.

9. An open-cockpit kayak comprising:

an elongated hull having an upper deck with a generally closed forward and aft section;

an elongated open cockpit formed in the upper deck of said hull being continuously open about a perimeter of said hull between said closed forward and aft sections for receiving a person in an open seated position unenclosed by said forward and aft sections;

a cockpit deck formed in said open cockpit generally below the level of said forward and aft sections and upper deck of said hull;

a contoured cockpit seat formed as a contoured depression in said cockpit below the level of said cockpit deck, said cockpit seat including a rear hip brace surface sloping upwards from a lower contoured seat portion towards said cockpit deck for bracing a person seated in said cockpit seat against rearward forces encountered during bracing and paddling of said kayak;

said thrust and support extensions extending vertically on opposing sides of said cockpit into an open area over and above the level of said cockpit deck and said contoured cockpit seat;

thigh brace means carried by said side extensions projecting inwardly toward the center of said kayak in an opposing manner terminating short of one another to define a leg receiving space by which the legs of said seated person may be received underneath said thigh brace means; and said thigh brace means and contoured seat means providing bracing forces between one another against a person seated in said open cockpit to effectively secure and retain said person in said cockpit during paddling and movement of said kayak through the water and to transmit thrusts for propelling the kayak.

10. The kayak of claim 9 including adjustment means carried on said side extensions for adjusting the longitudinal position of said thigh brace means relative to said side extensions.

11. The kayak of claim 9 wherein said side extension are generally rigid so that thrusts from the body of the person sitting in the cockpit resulting from manual paddle strokes are effectively transmitted through said thigh brace means and side extensions for propelling said kayak.

12. The kayak of claim 9 wherein said side extensions are formed of a generally rigid material and said thigh brace means includes a pair of curved wing members which project inwardly from said side extensions having concavely curved thigh engaging surfaces, said wing members flexing more than said side extensions so that said wing members tend to conform to the shape of said thighs of said person so that said thighs are firmly gripped in said concavely curved surfaces for bracing said person in said open cockpit.

13. The kayak of claim 9 wherein said open cockpit includes foot brace means for bracing the feet of a person sitting in the open cockpit, foot pressure on said foot brace means causing the hips of a person seated in said cockpit seat to be braced against said rear hip brace surface of said cockpit seat which causes said thighs of said person to be forced against said thigh brace means so that said person is effectively interlocked in said open cockpit for retention and thrust transmission.

14. The kayak of claim 9 including drain passages formed within the hull of said kayak communicating with a lower portion of said cockpit seat and the exterior of said hull for removing water from the cockpit seat.

15. An open-cockpit kayak comprising an elongated kayak hull having an upper deck with a forward and aft section, an elongated open cockpit formed in the upper deck of the kayak being continuously open about a perimeter of said cockpit for receiving a person in a seated position, a cockpit deck formed in said cockpit, a cockpit floor included in said open cockpit, foot brace means carried adjacent a front end of said cockpit floor against which the feet of said person engage, hip brace means carried adjacent a rear of said open cockpit against which a rear hip portion of said person is braced when the feet are braced against said foot brace means, and thigh brace means carried by opposing sides of said open cockpit and projecting over said cockpit deck at a position above the deck so that the thighs of a person braced between said foot brace means and hip brace means are urged against said thigh brace means so that said person is interbraced between said foot brace means, hip brace means, and thigh brace means for retention in said open cockpit and for transmitting paddle thrusts for propelling said kayak; and side thrust and support extensions extending vertically from opposing sides of said open cockpit, said thigh brace means including thigh braces carried by said side extensions which extend over said cockpit deck and project inwardly of said open cockpit at a position spaced above the cockpit deck so that the thighs of the person sitting in the cockpit are engaged in said thigh braces.

16. The kayak of claim 15 wherein said thigh brace means includes a pair of wing members projecting inwardly from the sides of said cockpit opening into a medial portion of said cockpit at a position above the cockpit deck, said wing members having a concavely curved thigh engaging surface engaged by said thighs of said person sitting in the open cockpit.

17. The kayak of claim 16 wherein said wing members are constructed from a relatively flexible material so that the concave curved surfaces which engage the thighs tend to conform to the thighs when engaged by said thighs under thrusts.

18. The kayak of claim 15 wherein said hip brace means includes a cockpit seat having a contoured seat portion for receiving the posterior portion of a person seated in said cockpit seat and an upwardly sloping hip brace surface which braces the hip of a person while the feet of the person are pushed against said foot brace means.

* * * * *